United States Patent [19]

Carlson et al.

[11] Patent Number: 4,467,337

[45] Date of Patent: Aug. 21, 1984

[54] CHEMICAL CARBONLESS COPY PAPER

[75] Inventors: Gene D. Carlson, Ankeny; Walter S. Trahanovsky, Ames, both of Iowa

[73] Assignee: Frye Copysystems, Inc., Des Moines, Iowa

[21] Appl. No.: 374,703

[22] Filed: May 4, 1982

[51] Int. Cl.[3] ..... B41M 5/22

[52] U.S. Cl. ..... 346/209; 346/212; 346/219; 346/225

[58] Field of Search ..... 282/27.5; 427/150, 151; 428/320.4, 320.6, 320.8, 488, 537, 913, 914, 411

[56] References Cited

U.S. PATENT DOCUMENTS 4,347,282 8/1982 Ehrhardt et al. ..... 428/320.4

*Primary Examiner*—Bruce H. Hess

*Attorney, Agent, or Firm*—Nims Howes Collison & Isner

[57] ABSTRACT

An improved chemical carbonless copy paper employing a selectively constituted hot melt coating for CB type pressure sensitive carbonless copy paper having discrete liquid droplets of a composite metallic salt solution chromogenic reagent material contained therein.

2 Claims, No Drawings

CHEMICAL CARBONLESS COPY PAPER

This invention relates to pressure sensitive information transfer and duplicating systems and particularly to an improved chemical carbonless copy paper of the CB type.

The subject matter disclosed and claimed herein is in the nature of an improvement for the hot melt CB coating disclosed and claimed in application Ser. No. 160,724 filed June 18, 1980, now U.S. Pat. No. 4,347,282.

Pressure sensitive image transfer media of diverse character are widely employed in the information recording and duplicating arts. Chemical type or so-called "carbonless" pressure sensitive transfer and duplicating systems, wherein a visable image is formed by the selective chemical reaction of two essentially colorless reagents, have been long recognized as a viable expedient for the formation of duplicate copy material. Such systems normally broadly comprise a substrate supported coating that contains a first normally inactive chemical reagent material that is selectively transferable in response to applied pressure into a reaction providing and color producing relationship with a second normally inactive chemical reagent material contained within or comprising a second coating disposed on the surface of an interfacially contiguous second substrate. Conventionally illustrative of such chemical type reproduction systems are transfer and duplicating systems wherein the rear surface on one paper sheet substrate is provided with a coating and which sheet is then termed a "CB" (i.e. coated back) sheet and the front side of that same and/or a separate paper sheet substrate is provided with a coating which is then termed a "CFB" (i.e. coated front and back) or "CF" (i.e. coated front) sheet, respectively. When the coatings on a CB and a CF sheet are placed in interfacially contiguous relation and subjected to selectively applied pressure, as by the pressure of a stylus or the impact of a typewriter key on the obverse surface of the CB sheet, the operative and usually colorless chemical reagents in such coatings are brought into co-reactive relationship, as for example on the surface of the CF sheet, to produce a colored image conforming to the contour of the selectively applied pressure member.

Such chemical type pressure sensitive transfer and duplicating systems are in widespread and expanding use at the present time for the making of multiple copies of selectively recordable duplicative information on sheet material, such as paper and the like, due, at least in part, to their basic cleanliness and to the fact that the color producing reagents are inactive until placed into operative co-reactive relationship in response to selective application of pressure.

Such "carbonless" transfer media as presently commercially employed and particularly those that conventially employ an encapsulated type vehicle for one of the reactive constituents, most usually an organic dyestuff, are not without disadvantage. Among the recognized disadvantages of such media are the fact that they are not only relatively expensive, requiring specialized fabricating techniques, but are also unduly pressure sensitive. Such undue sensitivity often results in undesired premature transfer occasioned by inadvertent dye precursor release and transfer resulting from pressures normally attendant packaging, handling and processing operations, spot coating delineation, printing operations and the like, particularly where multicopy manifolding operations are involved. In addition, such media are inherently subject to a progressively increasing lack of copy definition as the number of desired copies increases as well as by a fading of the copied image with time.

An improved chemical type transfer and duplicating system comprising a hot melt type of CB sheet coating containing and retaining discrete and selectively constituted liquid electron accepting chromogenic reagent material and to methods for forming the same is disclosed in said application U.S. Pat. No. 4,347,282 as noted above. As there disclosed such improved CB coating includes a hot melt CB coating constituted of an intermixture of natural and synthetic waxes containing and retaining discrete microscopic droplets of a selectively constituted solution of a metallic chloride, preferably zinc chloride, in water uniformly distributed therewithin as a color producing reagent and suitably buffered to control the available acidic component to minimize premature write.

Experience with the aforesaid improved CB coating under a wide range of ambient relative humidity levels has indicated a variation in write intensity that is attendant exposure of the media to relatively low relative humidities for extended periods of time. The practical effect thereof is a diminution in the intensity of a produced image in extremely dry climates, such as desert or other arid areas characterized by low relative humidity and particularly where the media has been stored for appreciable periods of time under such conditions prior to use.

We have discovered that such variation in write intensity attendant low humidity levels can be significantly minimized by the addition of a lithium compound, such as lithium chloride, to the water phase of the CB system described in the foregoing application.

This invention can therefore be briefly described as an improved hot melt CB transfer media having a coating formed of an intermixture of natural and synthetic waxes containing and retaining discrete microscopic droplets of a selectively constituted solution of a metallic chloride, such as zinc chloride, in water uniformly distributed therein as a color producing agent and incorporating a lithium compound, such as lithium chloride, in the water phase thereof.

Among the manifold advantages attendant the practice of the subject invention is the provision of improved low cost carbonless transfer media that serve to provide markedly increased numbers of duplicative copies with sharper, more intense and highly smear resistant transferred images over a wide range of ambient relative humidities. A further advantage is the provision of transferred images of relatively high intensity under ambient low humidity conditions and a transfer media characterized by extended shelf life under such ambient low humidity conditions.

The object of this invention is the provision of an improved composite wax base hot melt type of CB sheet coating containing discrete droplets of a selectively constituted water solution of a metallic chloride uniformly distributed therewithin as a color producing reagent and which provides intense transferred images even after extended storage under ambient low humidity conditions.

A further object of this invention is the provision of an improved water base metallic chloride solution for use as electron accepting chromogenic reagent material in carbonless transfer systems that contains a lithium compound to enhance transferred image intensity under ambient low humidity conditions.

Other objects and advantages of the subject invention will become apparent from the following portions of this specification which describe, in accord with the mandate of the patent statutes, the principles of the invention and best mode presently contemplated by the inventors for carrying out said inventions.

As described in the aforesaid copending application, the preferred hot melt CB sheet coating broadly comprises the resulting set or solidified film from an applied and subsequently cooled emulsified liquid intermixture of a melted low oil content wax carrier vehicle, preferably of composite character, a melted synthetic flow wax and dispersant and a chromogenic reagent solution of a metallic chloride, preferably zinc chloride, dissolved in water; said emulsified intermixture also uniformly dispersed therein small amounts of a resinous film forming agent to promote film hardness and toughness, a buffering agent to control the acidic chloride component and an opacifier-filler to reduce the gloss of the finished copy and preserve the appearance of the substrate and to which has been added small but critically limited amounts of a lithium compound, preferably lithium chloride.

In its narrower aspects and in accord with the foregoing application, the subject invention includes a hot melt CB sheet coating composition formed (weight basis) of about 35 to 75 percent of a meltable low oil content synthetic or naturally derived hard wax vehicle; at least 1 to about 15 percent of a chemically modified wax-like material having properties of a flow agent, dispersant and emulsifier; and at least 10 to about 35 percent of a chromogenic reagent component in the form of a Lewis acid, desirably an electron accepting hygroscopic, if not actually deliquescent, metallic salt desirably zinc chloride together with an amount of water necessary to desirably form a relatively concentrated solution thereof together with about 1–10% of a lithium compound, desirably lithium chloride.

Optionally but desirably included in such CB sheet coating composition for provision of an enhanced commercially attractive product are one or more of the following additional constituents. One such optional constituent comprises a film forming agent to encourage the formation of a harder and tougher surface film after setting and to thus minimize premature actuation of the color producing reaction. This film forming agent must be non-reactive with the chromogenic reagent and may vary in amount from a minimum of about 2% up to an amount that deleteriously affects the flow characteristics of the mix. A still further optional but desirable constituent is an opacifier-filler to enhance the appearance of the coated surface of the CB sheet, such as by reducing the gloss thereof. As is well known in this art, such opacifier-filler may vary in amount required to provide a desired appearance, typically about 5%, and may include titanium dioxide, various non-acidic high brightness clays, lithopone or other recognized materials.

As described in the foregoing application, the meltable wax vehicle may suitably comprise any of the low oil content paraffin waxes, microcrystalline waxes, carnauba, Montan or other conventionally employed low oil content vegetable, synthetic or mineral derived hot melt wax type carrier vehicles. The presently preferred meltable wax vehicle, a composite made up of about 3 to 4 parts of a low oil content paraffin wax, intermixed with about 1 part or less of carnauba wax. A presently preferred paraffin wax is a low oil content, high melting point, fully refined paraffin wax, suitably Pacemaker 53 as manufactured and sold by Cities Service Oil Co. of Tulsa, Okla. Such wax has the following properties:

| | |
|---|---|
| Melting point, ASTM, °F. | 143–150 |
| Melting point, AMP | 146–153 |
| Oil Content, Wt. % max | 0.25 |
| Odorless | |
| Viscosity, cs at 210° F. | 5.5 |
| Needle penetration at 77° F. | 13 |
| Flash point °F. | 485 |

Other suitable low oil content hot melt wax carrier vehicles include alpha olefinic waxes, suitably #6817 Synthetic Wax as available from Moore & Munger Inc. of Fairfield, Conn.; microcrystalline wax, suitably 195 Be Square White, available from Petrolite Corporations Bareco Division; carnauba wax, suitably Brazilian Refined available from Baldini & Company of Milburn, N.J.

The meltable chemically modified wax-like material having the desired properties of a flow agent, dispersant and emulsifier most suitably comprises a material of the type disclosed in U.S. Pat. No. 3,941,608. Other suitably chemically modified wax materials having the somewhat similar properties include modified synthetic waxes as disclosed in U.S. Pat. Nos. 2,890,124, 2,890,125 and 3,163,548. A preferred commercially available wax-like material formulated in accord with U.S. Pat. No. 3,941,608 is #7315 wax as sold by Moore & Munger, Inc. of Fairfield, Conn. Such #7315 wax has the following general properties:

| | |
|---|---|
| Penetration Hardness (FLP)I-22 | 5 Typical |
| Melting Point (Fisher Johns) | 144° Typical |
| Acid Number (ASTM D 974) | 2 Typical |

The resinous film forming agent serves to enhance the formation of a relatively hard and tough coating to minimize undesired transfer of reagent material across the CB/CF interface in the absence of intentional positive pressure application. A suitable film forming agent, which must be non-reactive with the chromogenic reagent component, desirably comprises a relatively low melting point ethylene-vinyl acetate copolymer, such as AC-400, as manufactured and sold by Allied Chemical Corporation. Such resinous film forming agent has the following properties:

| | |
|---|---|
| Softening Point (ASTM E-28) | 204° F. |
| Hardness dmm (ASTM D-5) | 9.5 |
| Density 8/cc (ASTM D-1505) | 0.92 |
| Viscosity (284° F. - Brookfield) | 550 |

The opacifier-filler, which cosmetically serves both to reduce the gloss of the finished coating and to preserve the appearance of the substrate, suitably comprises finely divided titanium dioxide such as UNITANE 0-110 as manufactured and sold by American Cyanamid Company. This material has a specific gravity of about 3.9 and is so finely divided as to leave only about a 0.10% residue on a 325 mesh screen.

The chromogenic reagent component preferably comprises a concentrated water base solution of zinc chloride as the electron accepting metallic chloride. Such solution is preferably made up of about 2 to 4 parts of zinc chloride with about 1 part of water and which approaches a saturated solution.

Other chromogenic reagent components comprise concentrated water base solutions of metallic halogen salts such as stannous chloride, ferric chloride and nickel chloride.

While unbuffered solutions of zinc chloride as the chromogenic reagent have provided highly effective image formation in transfer coating as formulated in accord with the foregoing disclosed formulations, such have been subject, under extreme climatic conditions of high temperatures and/or high humidity, to the apparent emanation of an acidic component which can cause premature color generation. Although the quantities of the acidic component so emanated appear to be minimal, even under such extreme climatic conditions, the apparent emanation thereof from the applied coating has resulted in varying degrees of premature actuation of the dye precursors over the entire surface of an interfacially contiguous CF coating and, depending on the ambient climatic conditions, in varying degrees of actuation of such CF sheet.

In order to neutralize, if not actually prevent, the emanation of such an acidic component, a small amount of a neutralizing material such as an ammonium salt, suitably ammonium carbonate or ammonium bicarbonate, is dissolved in the zinc chloride solution.

In accordance with the precepts of this invention, the hot melt CB coating as described above has added about 1–10% (weight basis) of a lithium compound, preferably from about 2–5% thereof, in the water phase thereof to enhance image intensity under low humidity conditions as would be encountered in desert or other arid areas and to extend shelf life under such conditions. While lithium chloride is the preferred lithium compound other compounds which exhibit similar water retention properties include lithium acetate, lithium bromide, lithium citrate, lithium sulfate and lithium benzoate.

By way of further examples the following formulations have provided CB sheet coating having in varying degree the advantages earlier set forth.

| | % |
|---|---|
| **EXAMPLE I** | |
| Paraffin Wax | 42.0 |
| Carnauba Wax | 3.0 |
| 7315 Wax | 2.0 |
| AC-400 Polyethylene | 5.0 |
| Titanium Dioxide | 5.0 |
| Zinc Chloride | 25.0 |
| Lithium Chloride | 3.0 |
| Ammonium Carbonate | 4.0 |
| Water | 11.0 |
| **EXAMPLE II** | |
| Paraffin Wax | 31.0 |
| Carnauba Wax | 8.0 |
| 7315 Wax | 2.0 |
| AC-629 Polyethylene | 5.0 |
| Titanium Dioxide | 3.0 |
| Lithium Acetate | 4.0 |
| Zinc Chloride | 30.0 |
| Ammonium Bicarbonate | 4.0 |
| Water | 13.0 |
| **EXAMPLE III** | |
| Paraffin Wax | 42.0 |
| Carnauba Wax | 5.0 |
| AC-629 Polyethylene | 7.0 |
| Zinc Chloride | 25.0 |
| Lithium Bromide | 3.0 |
| Water | 11.0 |
| 7315 Wax | 2.0 |
| Potassium Hydroxide | 2.0 |
| Titanium Dioxide | 3.0 |
| **EXAMPLE IV** | |
| Paraffin Wax | 41.0 |
| Carnauba Wax | 8.0 |
| AC-629 Polyethylene | 5.0 |
| Zinc Chloride | 20.0 |
| Lithium Chloride | 4.0 |
| Ammonium Carbonate | 4.0 |
| Water | 13.0 |
| 7315 Wax | 2.0 |
| Titanium Dioxide | 3.0 |

Having thus described our invention, we claim:

1. In a pressure sensitive chemical type transfer medium formed of planar sheet material having an at least partially transferable coating layer disposed on one surface thereof constituted by the solidified residue of an applied hot melt low oil content wax base emulsified liquid film having discrete liquid droplets of a concentrated water base solution of ionized zinc chloride distributed therein, the improvement comprising about 1–10% by weight of lithium chloride incorporated in the water phase thereof to enhance water retention and formed image intensity under ambient low humidity conditions.

2. The improvement as set forth in claim 1 wherein said lithium chloride concentration comprises 2 to 5%.

* * * * *